United States Patent [19]

Fonio

[11] Patent Number: 4,606,533

[45] Date of Patent: Aug. 19, 1986

[54] MACHINE FOR CONVERTING ROLLED CLOTH INTO SHEETS

[75] Inventor: Carlo Fonio, Galliate, Italy

[73] Assignees: Rockwell-Rimoldi S.p.A., Italy; Officina Mecannica Mario Fonio, Italy

[21] Appl. No.: 809,634

[22] Filed: Dec. 16, 1985

[30] Foreign Application Priority Data

May 31, 1985 [IT] Italy ..... 22051/85[U]

[51] Int. Cl.[4] ..... B65H 29/46

[52] U.S. Cl. ..... 270/31; 242/86.5 R

[58] Field of Search ..... 270/30–31; 242/86.5

[56] References Cited

U.S. PATENT DOCUMENTS

| | | | |
|---|---|---|---|
| 3,735,223 | 5/1973 | Fort et al. | 270/30 X |
| 3,811,669 | 5/1974 | Benson et al. | 270/31 |
| 4,177,980 | 12/1979 | Melega | 270/31 |
| 4,436,296 | 3/1984 | Fonio | 270/31 |

*Primary Examiner*—E. H. Eickholt

[57] ABSTRACT

A machine for laying out flat sheets made from tubular fabric in which a horizontal cross bar is hingedly connected to a supporting frame and is in contact with the fabric being fed, so that variations of the tautness of the fabric causes the cross bar to pivot and change the speed of a variable speed drive motor, thereby changing the rate of feed of the fabric.

6 Claims, 2 Drawing Figures

MACHINE FOR CONVERTING ROLLED CLOTH INTO SHEETS

BACKGROUND OF THE INVENTION

The present invention relates to a machine for converting rolled cloth, consisting of a fabric or of any other material, for example plastic, into sheets.

As is known, sheet-making machines are used for stacking fabrics or other materials initially arranged in roll form. These machines, in fact, have a surface for storing the sheets to be stacked and a mobile carriage which is located on the said storage surface and supplies the fabric or similar material to be stacked. The distance traveled by the mobile carriage, which performs alternating movements, determines the width of the sheets to be stacked.

Previous studies by the same applicant have already led to the development of a particularly efficient sheet-making machine with many advantages, owing, in particular, to a loading device designed to position and automatically unwind a roll. This loading device comprises, in fact, forked levers designed to hold and move a bar about which a said roll revolves, as well as unwinding means and conveyor belt means which can be directly engaged by the roll, the axial bar of which is inserted between the forked levers. In practice, during unwinding the roll is held so as to be substantially free and rest against the conveyor belt means, which ensure that the fabric or similar material to be stacked is unwound in a precise manner. It must also be added that the abovementioned forked levers can be swung up so as to transfer automatically the rolls from a loading station to the abovementioned conveyor belt means.

This sheet-making machine has proved to be completely satisfactory. However, it has been noted that the same machine needs to be improved further with regard to the devices which control the speed at which the fabric or similar material is fed onto the said stacking surface.

In fact, it is known that, in order for the sheets of cloth to be arranged precisely on top of each other during unrolling, the speed at which the cloth itself is fed must be identical to the speed at which the mobile carriage performs the alternating translatory motion. Only in this manner can the fabric or similar material which is supplied be prevented from slipping horizontally with respect to the stacking surface and precise stacking be achieved.

The currently available devices for controlling the fabric feed rate are unsatisfactory for various reasons.

Some of these devices consist of two bars rotatable about a middle axis of rotation located between the same. The said bars give an S-shaped trajectory to the fabric. This device is useful, in particular, for tensioning initially the cloth during unwinding, but cannot be employed effectively to correct any errors in the speed at which the cloth is fed.

There are other devices where the rollers around which the fabric or similar material is partially wound during unwinding are each driven by an associated motor and where at least one of these motors has a variable speed which can be set by means of special controls. With these devices, the presence of an operator who is able to use the said controls is always required.

Finally, control devices are known which are able to determine the degree of tensioning the fabric or similar material being stacked and automatically adjust the motors which control the feed movement of the fabric itself.

These devices are also somewhat unsatisfactory since they do not allow continuous adjustment of the speed at which the cloth is unwound, but only partial and in any case substantially imprecise adjustment thereof.

The sheet-making machine already designed by the same applicant has been able to use, until now, known devices for controlling the feed rate of the fabric, thanks to the precision of the already mentioned loading device, which partly compensates for the deficiencies of the control devices since it avoids, from the outset, many irregularities in the way the cloth is fed. However, as is obvious, if an efficient and satisfactory device for controlling the fabric feed rate were to be developed and applied to the said sheet-making machine, it would mean that the sheet-making machine itself would operate with an exceptional degree of precision in all situations.

The general object of the present invention is precisely to design a machine for converting rolled cloth into sheets, of the type already developed by the same applicant, which also has an efficient and advantageous device for controlling the feed rate of fabric or similar material to be stacked. Within the scope of this general object, an important object of the present invention is to design a sheet-making machine with a control device which has a simple structure and can be easily applied to the machine itself at a low cost and with a minimum of inconvenience.

These objects and others which will emerge more clearly below are substantially achieved by a machine for converting rolled cloth into sheets, comprising at least a surface for stacking the sheets of fabric or similar material and a mobile carriage located on the said stacking surface and provided with a loading device designed to position and automatically unwind a roll, the said loading device comprising in particular forked levers designed to hold and move an axial bar of the said roll as well as unwinding means and conveyor belt means with which the said roll can be directly engaged, the said machine having a device for controlling the fabric feed rate, which device comprises a bar transverse to the direction in which the said fabric is fed and held oscillatably; by the said carriage in a position tending to form a hollow in the fabric itself, and a speed regulator which is able to detect the oscillations of the said bar and is designed to control a variable-speed electric motor which causes the said fabric to be fed.

DESCRIPTION OF THE DRAWINGS

Further characteristic features and advantages will emerge more clearly from the description of a preferred embodiment of the invention, illustrated by way of example in the attached drawings in which.

DESCRIPTION OF THE INVENTION

Figure 1:
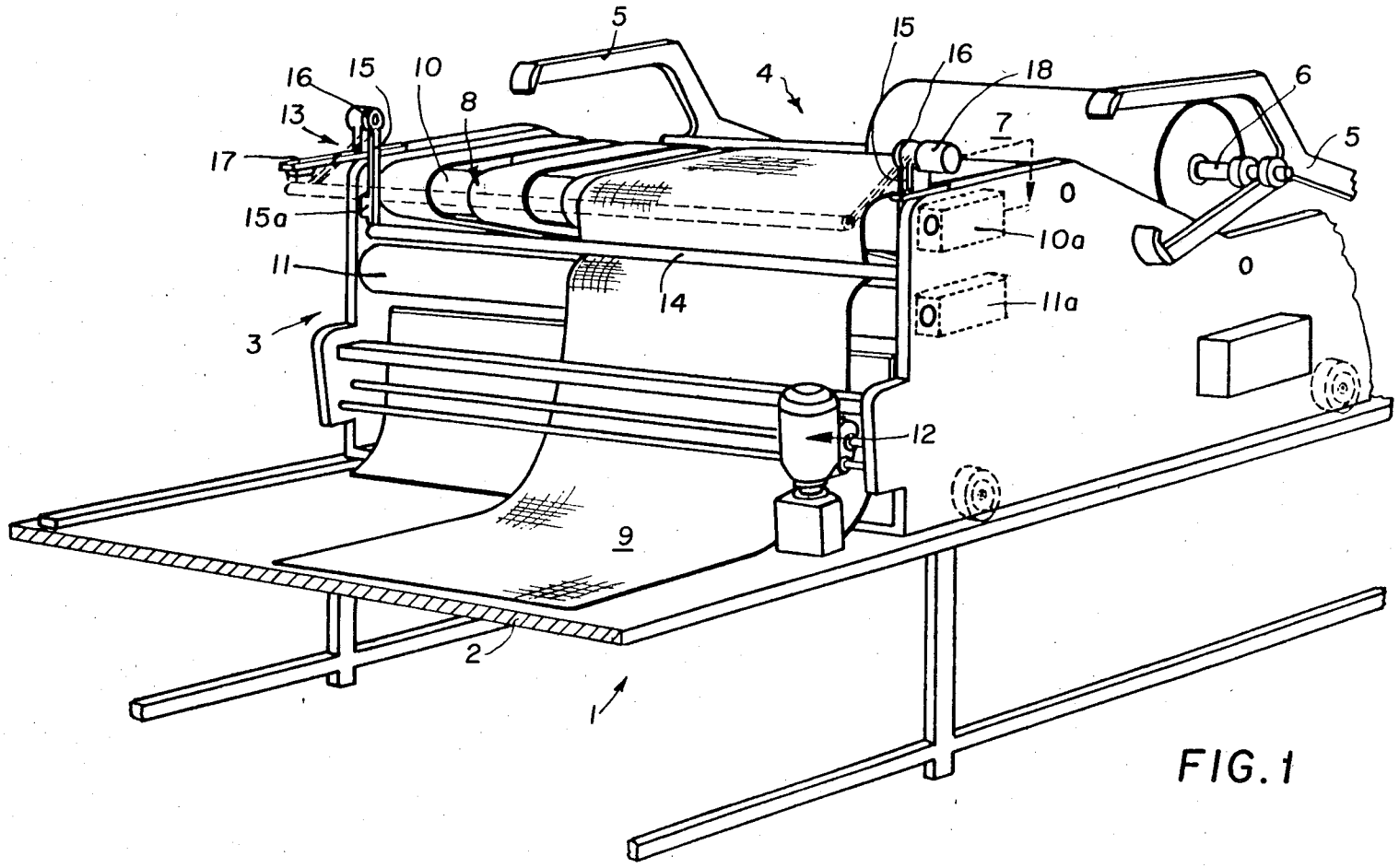
FIG. 1 is a perspective view, from the front, of the sheet-making machine according to the present invention.

With reference to the figures mentioned, the sheet-making machine according to the present invention is indicated in its entirety by the reference number 1. It comprises, in keeping with the previous studies made by the same applicant, a stacking surface 2 which has a mobile carriage 3 mounted on it and is provided with a loading device 4 shown in detail in FIG. 2. The loading device 4 is substantially defined by a pair of forked levers 5 designed to engage with the ends of an axial bar 6 around which a roll 7 consisting of a fabric or of other material is wound. The forked levers 5 can be swung up from the position shown in FIG. 2 to the position shown in FIG. 1 and vice versa so as to bring the roll 7 into contact with the conveyor belt means 8 also forming part of the loading device 4. These conveyor belt means 8 guide the unrolled fabric or similar material over a considerable distance and, by means of localized contact with the roll 7, ensure that the roll itself is unwound in a precise manner.

As shown in FIG. 1, the fabric 9 or similar material, after leaving the conveyor belt means 8 and a first roller 10 defining one end of the said conveyor belt means, is taken up by a second roller 11 underneath which there is a cutting assembly 12. After passing through the cutting assembly 12, the fabric 9 is arranged on the stacking surface 2.

Figure 2:
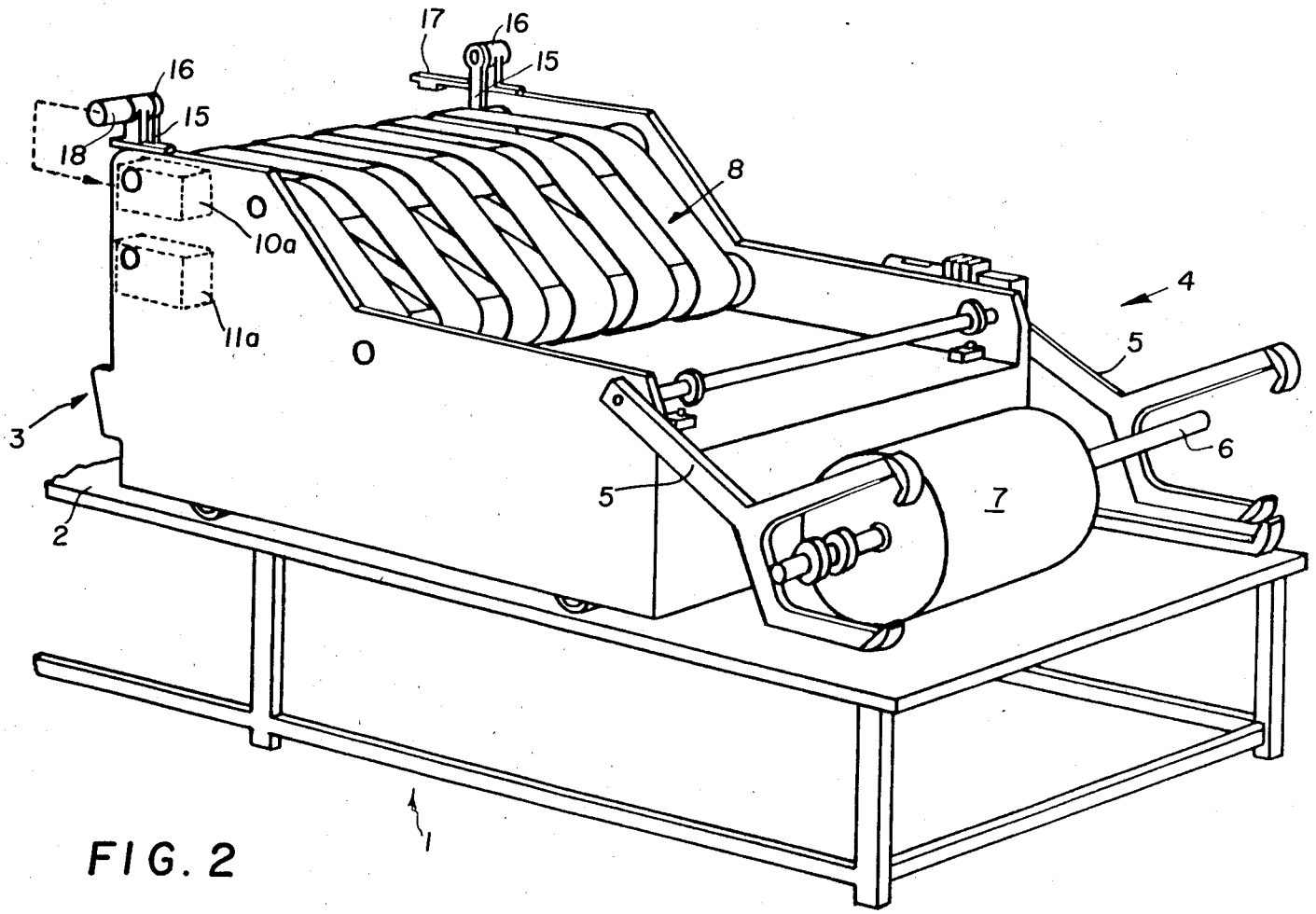
FIG. 2 is a perspective view of the same sheet-making machine from the rear, the machine being shown in a different operating position.

FIG. 2 shows in dotted lines a first motor 10*a* driving the first roller 10 and a second motor 11*a* driving the second roller 11. These motors 10*a*, 11*a* are electric direct-current motors and, in particular, the first motor 10*a*, which drives the first roller 10, is a variable-speed electric motor operated by a device 13 for controlling the feed rate of the fabric 9. The control device 13 comprises, in particular, a bar 14 arranged transversely to the direction of movement of the fabric 9 and held oscillatably by the carriage 3. This is achieved by means of rod-shaped end supports 15 fixed at one end to the bar 14 and at the opposite end to hinges 16. In practice, the bar 14 is arranged in hanging fashion and tends to form a hollow in the fabric 9 between the first roller 10 and the second roller 11. At least one rod-shaped support 15 is provided with a magnetic component 15*a* which can be engaged with a fixed crosspiece 17 projecting in cantilever fashion from the carriage 3, so that the said crosspiece can be set in a non-working position during initial loading of the fabric 9. Advantageously, a speed regulator 18 is provided next to the hinge 16 located on the same side as the first motor 10*a*, which regulator is able to detect the oscillations of the bar 14 and is designed to control the first variable-speeds electric motor 10*a*. The speed regulator 18 may consist of an impedance variator which, depending on the angular position of the adjacent rod-shaped support 15, controls the speed of the first electric motor 10*a*.

Operation of the sheet-making machine according to the present invention is as follows.

In the same manner as in the abovementioned previous studies by the same applicant, the roll 7 is arranged on the forked levers 5 (FIG. 2) and then the latter are swung up so as to bring the roll 7 itself into contact with the conveyor belt means 8 (FIG. 1). The fabric 9 or similar material is unwound from the roll 7 and travels over the rollers 10 and 11, finishing up on the stacking surface 2, after passing through the cutting assembly 12. The backwards and forwards alternating movement of the carriage 3 is such that the fabric 9 is stacked, forming a series of sheets arranged on top of each other, with a width equal to the distance traveled by the carriage itself. The fabric is substantially static with respect to the stacking surface 2 since the fabric is fed at the same speed at which the carriage 3 moves.

Between the first roller 10 and the second roller 11, the fabric 9 is taken up by the bar 14 which, with its weight, tends to form a hollow in the fabric itself, as shown in FIG. 1.

When the fabric feed rate is uniform and at the required speed, the hollow defined by the bar 14 is of relatively small proportions and the corresponding position of the rod-shaped supports 15 is detected or regarded by the speed regulator 18 as the equilibrium or zero position. This reference position must be fixed in advance by means of experimental tests.

In these circumstances, the speed of the first motor 10*a* and the speed of the second motor 11*a* remain constant.

When, owing to a particular problem, the fabric 9 is fed at a different speed from the optimum speed, the fabric 9 or similar material becomes slack or, on the other hand, taut between the conveyor belt means 8 and the stacking surface 2. This occurs because either too much fabric or too little fabric is fed in relation to the speed at which the carriage 3 moves.

As a result of this phenomenon, the bar 14 tends to form a more or less deep hollow and therefore the rod-shaped supports 15 rotate in relation to the hinges 16. These movements are detected by the speed regulator 18, which actuates the electric motor 10*a* so as to reduce or increase the rotational speeds of the first roller 10, in order to compensate for any inaccuracies in the way in which the fabric is supplied.

The speed regulator 18 can be made to operate continuously, each time there is minimal movement of the bar 14 from the zero or reference position.

The invention thus achieves the proposed objects.

In practice, a sheet-making machine has been developed which is complete and offers every guarantee as to precise and reliable operation.

All the details can be replaced by technically equivalent elements.

In practice, the materials used, forms and dimensions may be of any nature or magnitude, as required.

I claim:

1. In a machine for converting rolled cloth into sheets wherein there is provided at least one surface for stacking the sheets of fabric or similar material, a mobile carriage located on the said stacking surface and a loading device having forked levers designed to hold and move the axial bar of the roll between loading and unwinding portion, the combination comprising a device for controlling the fabric feed rate, which device comprises a bar extending transverse to the direction in which the said fabric is fed and held oscillatably by the said carriage in a position tending to form a hollow in the fabric itself, and a speed regulator which is able to detect the oscillations of the said bar and to control a variable-speed electric motor which causes the said fabric to be fed.

2. A machine as defined in claim 1, wherein the said speed regulator is an impedance variator designed to vary continuously the speed of the said electric motor.

3. A machine as defined in claim 1, wherein the said electric motor is connected to a first roller around which the said fabric is partially wound, and wherein the said first roller has alongside it a second roller operated by a second electric motor, the said bar being located between the said rollers so as to form the said hollow.

4. A machine as defined in claim 1, wherein the said bar is fixed in hanging fashion to the said carriage by means of rod-shpaed end supports, and wherein the said speed regulator is provided next to hinges for holding the said rod-shaped supports, the said speed regulator being able to detect the angular position of the said rod-shaped supports.

5. A machine as defined in claim 1, wherein the said bar is integral with magnetic components which can be detachably engaged with at least one fixed crosspiece projecting from the said carriage, so as to arrange the bar itself in the rest position.

6. A machine as defined in claim 1, wherein the said variable-speed electric motor operates a first roller which forms an end component of the said conveyor belt means.

* * * * *